US008348078B2

(12) United States Patent
Lane

(10) Patent No.: US 8,348,078 B2
(45) Date of Patent: Jan. 8, 2013

(54) LEAK PROOF DRINKING LID WITH PRESSURE RELIEF

(75) Inventor: Marvin Lane, Round Lake Beach, IL (US)

(73) Assignee: Thermos L.L.C., Rolling Meadows, IL (US)

( * ) Notice: Subject to any disclaimer, the term of this patent is extended or adjusted under 35 U.S.C. 154(b) by 342 days.

(21) Appl. No.: 12/705,000

(22) Filed: Feb. 12, 2010

(65) Prior Publication Data

US 2011/0198349 A1 Aug. 18, 2011

(51) Int. Cl.
*B65D 51/16* (2006.01)
*A47G 19/22* (2006.01)

(52) U.S. Cl. ..... 220/203.29; 220/203.04; 220/203.07; 220/203.1; 220/203.17; 220/703; 220/711; 220/714

(58) Field of Classification Search ..... 220/203.01, 220/203.04, 203.07, 203.09, 203.1, 203.13, 220/203.17, 203.19, 203.29, 254.1, 254.9, 220/703, 711, 714, 715
See application file for complete search history.

(56) References Cited

U.S. PATENT DOCUMENTS 5,392,967 A * 2/1995 Satomi et al. ..... 222/509
5,944,235 A * 8/1999 Won ..... 222/506
6,299,037 B1 * 10/2001 Lee ..... 222/518
6,702,138 B1 * 3/2004 Bielecki et al. ..... 220/254.9
7,073,678 B1 * 7/2006 Dibdin et al. ..... 220/254.1
7,681,754 B1 * 3/2010 Ross ..... 220/714
7,997,442 B2 * 8/2011 Pinelli ..... 220/715

FOREIGN PATENT DOCUMENTS

JP 2004-315009 11/2004
JP 2005-278855 10/2005

* cited by examiner

*Primary Examiner* — Anthony Stashick
*Assistant Examiner* — Madison L Poos
(74) *Attorney, Agent, or Firm* — Wood, Phillips, Katz, Clark & Mortimer

(57) ABSTRACT

A leak proof/resistant drinking lid (10) is provided for use with beverage container. The lid (10) includes a manually actuated valve stem (16) mounted to a housing (14), a drinking port (18) extending through the housing (14), a drinking valve head (20) carried on the stem (16), a pressure relief port (22) extending through the drinking valve head (20), and a pressure relief valve head (24) mounted to the stem 16. The pressure relief valve head (24) is releasably mounted to the stem (16) by a connector (26). A resilient member (28) is sandwiched between the stem (16) and the drinking valve head (20) to transmit an actuating force from the stem (16) to the drinking valve head (20) and to allow the stem (16) and the pressure relief valve head (24) to translate relative to the drinking valve head (20).

20 Claims, 3 Drawing Sheets

56
56
14
38
58
40
44
54
50
56
54
28
29
52
74
56
16
82
102
98
100
20
96
22
93
96
78
92
24

LEAK PROOF DRINKING LID WITH PRESSURE RELIEF

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to drinking lids for beverage containers such as mugs or tumblers, and more particularly, to leak proof/resistant lids that can be selectively opened for drinking and closed to prevent leakage of the beverage within the container.

BACKGROUND OF THE INVENTION

It is known to provide drinking lids for beverage containers such as tumblers and mugs to help maintain the temperature of the beverage within the container and to reduce the spillage of the beverage from the container during use. It is further known to provide such lids with drinking ports that can be selectively opened to allow a user to drink beverage from the container and closed so as to restrict or prevent leakage of the beverage from the container. One known way of providing this function is to provide a stopper or seal for the drinking port that is pivotally mounted to the lid between an open and closed position. Another known solution is to provide a valve on an internal side of the lid that can be selectively actuated by user between an open position and a closed position. One problem with such valves is that they may not have a sufficient amount of open area to provide a desired flow rate of the beverage from the container. One known solution to this problem is to provide a disk-shaped valve head that provides an opening area with a diameter that is slightly smaller than the inside diameter of the container adjacent the valve head. However, one problem associated with such disk-shaped valve heads is that a pressure differential can form across the valve head making it difficult to open. In answer to this problem, it is known to provide a pressure relief valve that can be opened so as to equalize the pressure across the valve head.

While known lid constructions may be suitable for their intended purpose, there is always room for improvement.

SUMMARY OF THE INVENTION

In accordance with one feature of the invention, a leak resistant, drinking lid is provided for use with a beverage container. The lid includes a housing to mount the lid to the container, a manually actuated valve stem mounted to the housing to translate relative to the housing in response to manual actuation by a user, a drinking port extending through the housing to allow a beverage in the container to pass through the lid for drinking by a user, a drinking valve head carried on the stem for movement relative to the housing between a closed position closing the drinking port and an open position wherein the beverage can flow through the drinking port, a pressure relief port extending through the drinking valve head to allow equalization of pressure across the drinking valve head with the drinking valve head in the closed position, and a pressure relief valve head releasably mounted to the stem by a connector for movement relative to the drinking valve head between a closed position closing the pressure relief port and an open position wherein air can pass through the pressure relief port. The drinking valve head is captured on the stem by the pressure relief valve head.

As one feature, the lid further includes a resilient member sandwiched between the stem and the drinking valve head to transmit an actuating force from the stem to the drinking valve head and to allow the stem and the pressure relief valve head to translate relative to the drinking valve head. In a further feature, the resilient member is a resilient sleeve through which a portion of the stem extends. As yet a further feature, the resilient sleeve has an annular rib received within an annular groove of the stem to fix the sleeve to the stem. In a further feature, the drinking valve head has a surface engaged with the resilient sleeve, the surface interrupted by a plurality of grooves to allow a flow of air past the sleeve with the pressure relief valve head in the open position.

According to one feature, the lid further includes an annular seal sandwiched between the pressure relief valve head and the stem. In one feature, the seal is also sandwiched between the pressure relief valve head and the drinking valve head with the pressure relief valve head in the closed position. In yet a further feature, the pressure relief valve head includes an annular flange received in an annular groove of the seal to retain the seal on the valve head.

In one feature, the connector is a bayonet type connector. In a further feature, the bayonet type connector includes a pair of lugs on the pressure relief valve head and a pair of corresponding lug receiving grooves in the valve stem.

As one feature, the lid further includes a push button actuator engaged with the valve stem to allow a user to translate the valve stem relative to the housing. In a further feature, the push button actuator includes a pair of mating ramped surfaces, the surfaces movable relative to each other between first and second positions in response to an actuating force applied by a user, the first position allowing the drinking valve head to move to the closed position, the second position maintaining the drinking valve head in the open position.

According to one feature, the lid includes a spring sandwiched between the valve stem and the housing to urge the valve heads toward the closed positions. As a further feature, the spring is a helical spring. In yet a further feature, the valve stem includes an annular flange engaged against the spring, the valve stem being a one-piece construction.

In accordance with one feature of the invention, a leak resistant, drinking lid is provided for use with a beverage container. The lid includes a housing to mount the lid to the container, a manually actuated valve stem mounted to the housing to translate relative to the housing in response to manual actuation by a user, a drinking port extending through the housing to allow a beverage in the container to pass through the lid for drinking by a user, a drinking valve head carried on the stem for movement relative to the housing between a closed position closing the drinking port and an open position wherein the beverage can flow through the drinking port, a pressure relief port extending through the drinking valve head to allow equalization of pressure across the drinking valve head with the drinking valve head in the closed position, a pressure relief valve head carried on the for movement relative to the drinking valve head between a closed position closing the pressure relief port and an open position wherein air can pass through the pressure relief port, with the drinking valve head captured on the stem by the pressure relief valve head, and a resilient member sandwiched between the stem and the drinking valve head to transmit an actuating force from the stem to the drinking valve head and to allow the stem and the pressure relief valve head to translate relative to the drinking valve head.

As one feature, the resilient member is a resilient sleeve through which a portion of the stem extends. In a further feature, the resilient sleeve has an annular rib received within an annular groove of the stem to fix the sleeve to the stem. According to yet a further feature, the drinking valve head has a surface engaged with the resilient sleeve, the surface interrupted by a plurality of grooves to allow a flow of air past the sleeve with the pressure relief valve head in the open position.

In one feature, the pressure relief valve head is connected to the stem with a bayonet type connection.

Other objects, features, and advantages of the invention will become apparent from a review of the entire specification, including the appended claims and drawings.

DETAILED DESCRIPTION OF THE PREFERRED EMBODIMENT

Figure 1:
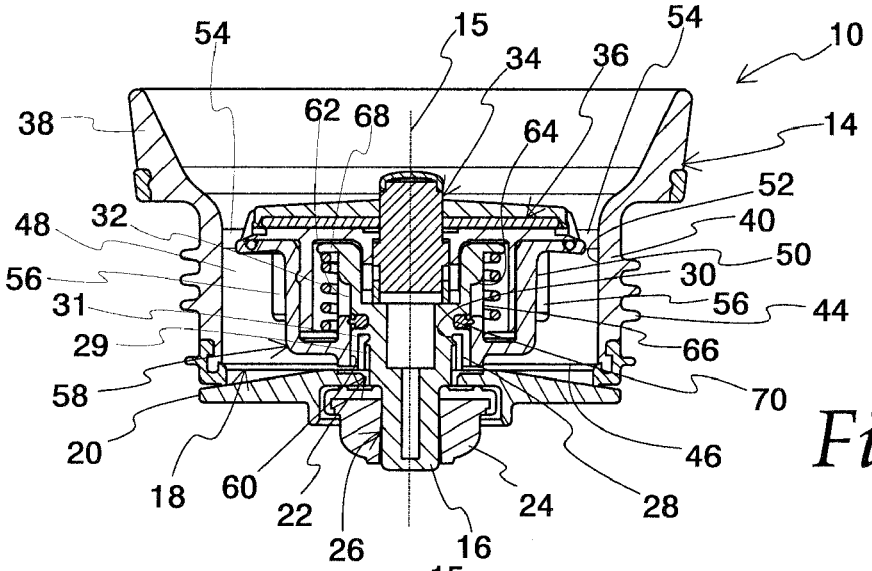
FIG. 1 is a cross-sectional view of a drinking lid embodying the present invention showing a drinking valve head and a pressure relief valve head in a closed position.
Figure 2:
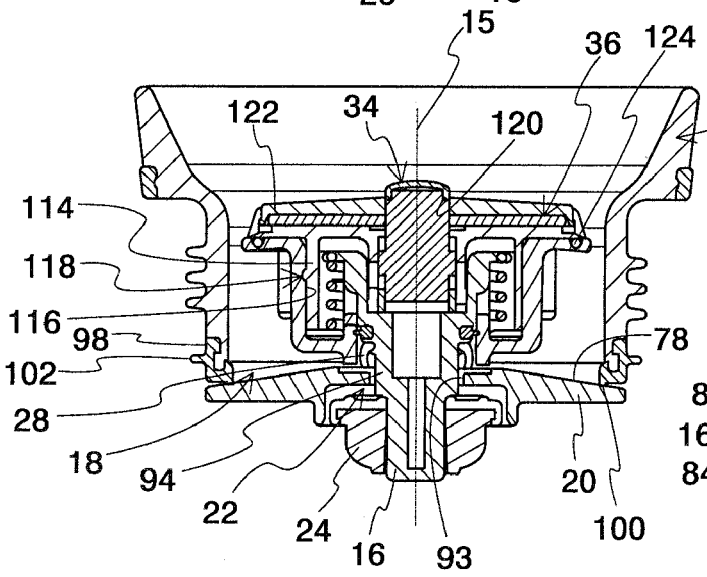
FIG. 2 is a view similar to FIG. 1, but showing the pressure relief valve head of the lid in an open position with the drink valve head in a closed position.
Figure 2A:
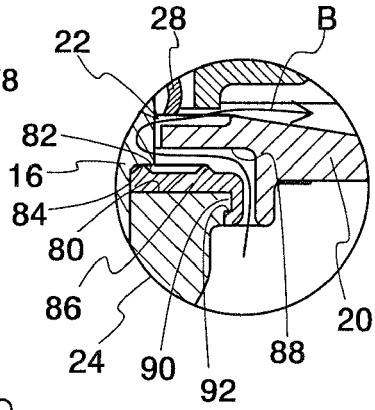
FIG. 2A is an enlarged view of the encircled portion of FIG. 2.

With reference to FIG. 1, a leak proof/resistant drinking lid 10 is provided for use with beverage container (not shown), such as a tumbler or mug. The lid 10 includes a housing 14 to mount the lid 10 to the beverage container, a manually actuated valve stem 16 mounted to the housing 14 to translate along a central axis 15 relative to the housing 14 in response to manual actuation by a user, a drinking port 18 extending through the housing 14 to allow a beverage to pass through the lid 10 for drinking by a user, a drinking valve head 20 carried on the stem 16 for movement relative to the housing 14 between a closed position closing the drinking port 18 (FIGS. 1 and 2) and an open position (FIG. 3) wherein the beverage can flow through the drinking port 18, as shown by arrows A in FIG. 3. A pressure relief port 22 extends through the drinking valve head 20 to allow equalization of pressure across the drinking valve head 20 with the drinking valve head 20 in the closed position, and a pressure relief valve head 24 is mounted to the stem 16 for movement relative to the drinking valve head 20 between a closed position (FIGS. 1 and 3) closing the pressure relief port 22 and an open position (FIGS. 2 and 2A) wherein air can pass through the pressure relief port 22, as shown by arrows B in FIG. 2A. The pressure relief valve head 24 is releasably mounted to the stem 16 by a connector, shown generally at 26 in FIG. 1, and the drinking valve head 20 is captured on the stem 16 by the pressure relief valve head 24. A resilient member in the form of a resilient sleeve 28 is sandwiched between the stem 16 and the drinking valve head 20 to transmit an actuating force from the stem 16 to the drinking valve head 20 and to allow the stem 16 and the pressure relief valve head 24 to translate relative to the drinking valve head 20, as best seen in FIGS. 2 and 2A. The resilient sleeve 28 is piloted on a cylindrical portion 29 of the valve stem 16 and preferably includes an annular rib 30 that engages with an annular groove 31 in the valve stem 16 to retain or fix the sleeve 28 to the stem 16.

Preferably, a helical spring 32 is sandwiched between the valve stem 16 and the housing 14 to urge the valve heads 20 and 24 towards their closed position. The lid 10 preferably includes a push button actuator 34 that is engaged with the valve stem 16 to allow a user to translate the valve stem 16 relative to the housing 14 to actuate the valve heads 20 and 24 between their open and closed positions. In the illustrated embodiment, the push button actuator 34 is mounted in an actuator housing 36, which in turn is mounted to the housing 14.

Turning in more detail to the construction of the illustrated embodiment, the housing 14 includes an upwardly extending annular flange 38 and a downwardly extending, generally cylindrical mounting skirt 40 that is sized to fit within the mouth of the beverage container for mounting the lid 10 to the beverage container. It should be understood that while the illustrated embodiment shows the skirt 40 as being sized to fit within the mouth of the beverage container, the skirt 40 could be sized to extend around the exterior of the container for mounting the lid 10 to the beverage container. Any suitable form of connection can be used to connect the skirt 40 to the beverage container, such as, for example, threaded fasteners and/or frictional engagement and/or snap engagements. In the illustrated embodiment, the skirt 40 includes external threads 44 that are engageable with internal threads in the mouth of the beverage container.

The drinking port 18 is provided in the form of a circular opening 46 defined by the lower end of the skirt 40, a generally annular-shaped chamber 48 defined between two generally cylindrical walls 50 and 52 of the housing 14, and a pair of arcuate apertures or openings 54 formed symmetrically opposite from each other in the housing 14. The inner cylindrical wall 50 is connected to the skirt 40 via a plurality of radially extending ribs 56 and serves to define a mount housing 58 for the valve stem 16. In this regard, the mount housing 58 includes a cylindrical guide surface 60 centered on the axis 15 for guiding the valve stem 16 as it translates along the axis 15. Further in this regard, the valve stem 16 includes a corresponding cylindrical guide surface 62 that is sized to have a sliding fit with the guide surface 60 of the mount housing 58, a shoulder 64 for engagement a stop surface 66 on the mount housing 58 to limit the translation of the valve stem 16 along the axis 15, and an annular flange 68 for engagement with the spring 32. Preferably, an annular, seal 70 is carried in a groove on the valve stem 16 and engages the cylindrical guide surface to prevent or restrict leakage of the beverage past the stem 16 while stationary and during translation. While the mount housing 58 is shown as an integral unitary part of the housing 14, which is preferred, it should be understood that in some applications it may be desirable for the housing 14 to include the mount housing 58 as a separable part or component that is assembled to the housing 14.

Figure 4:
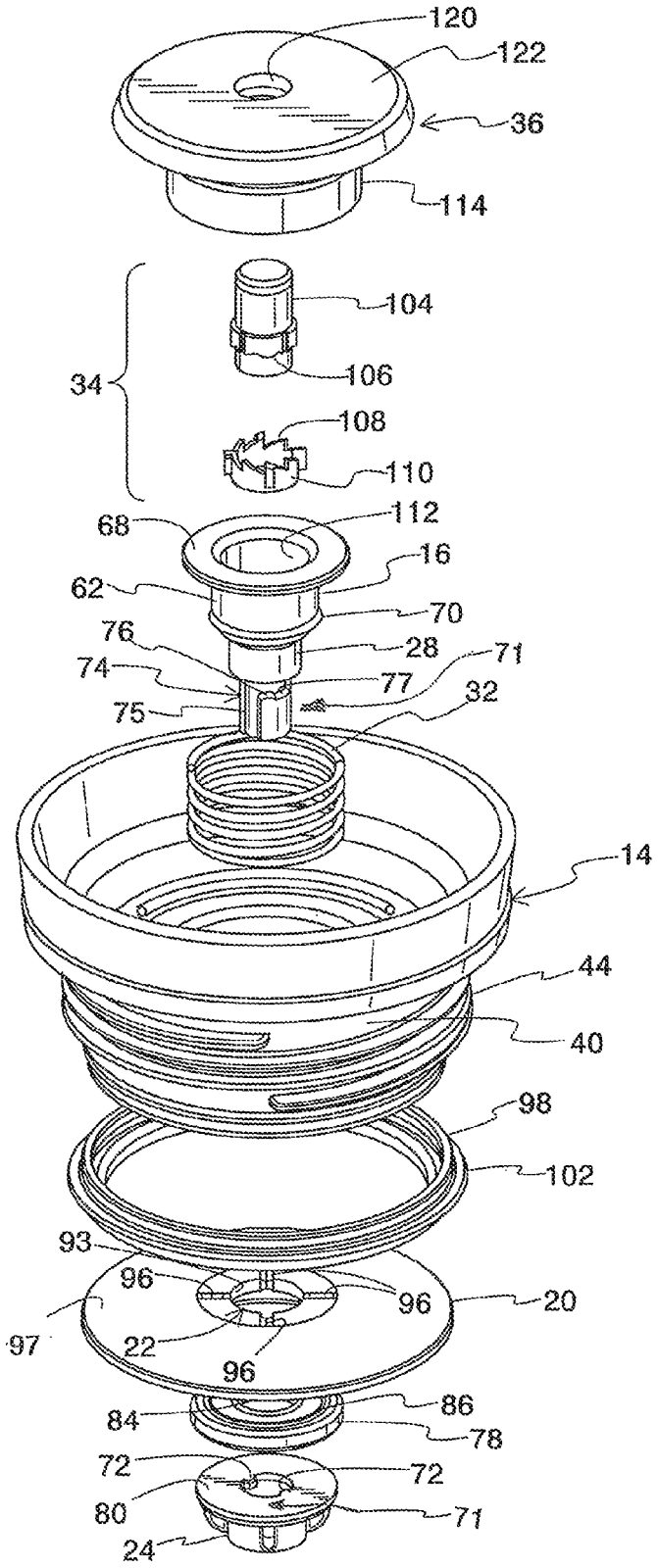
FIG. 4 is an exploded isometric view from above of the lid of FIGS. 1-3.
Figure 5:
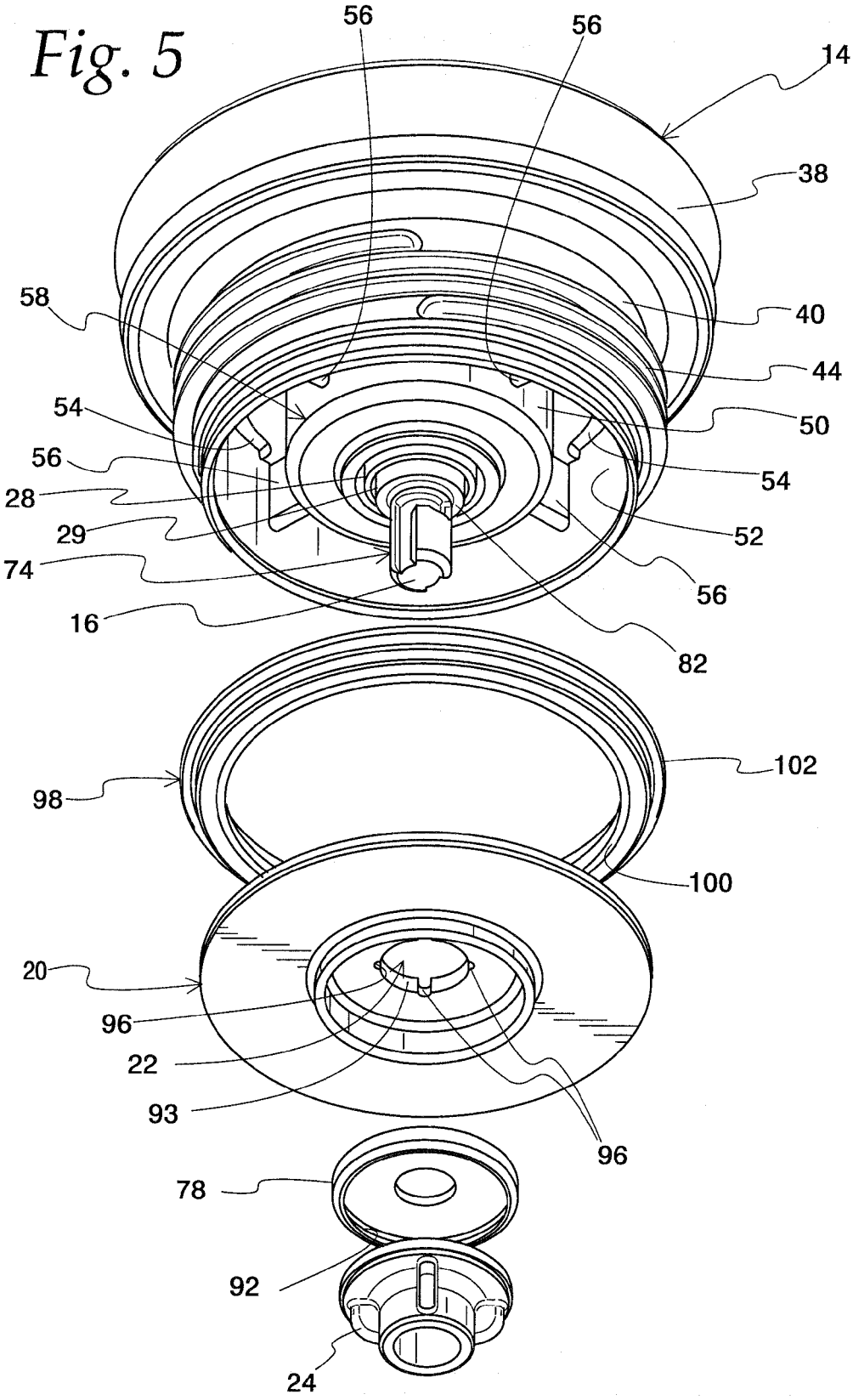
FIG. 5 is an exploded isometric view from below of the lid of FIGS. 1-3.

In a highly preferred form, the connector 26 is a bayonet-type connection 71, best seen in FIGS. 4 and 5, and includes a pair of symmetrically spaced lugs 72 on the pressure relief valve head 24 and a pair of corresponding lug receiving grooves 74 (only one shown in FIGS. 4 and 5) in the valve stem 16. Each of the lug receiving grooves 74 includes an axially extending portion 75 coupled with a circumferentially extending portion 76 and a lug receiving recess 77 that holds the lugs 72 with the connection 71 in a locked or assembled position. The bayonet-type connection 71 is preferred because it provides for a secure connection between the pressure relief head 24 and the valve stem 16, while allowing the pressure relief head 24 to be quickly and easily removed from the valve stem 16 for cleaning of the various components of the lid 10. Furthermore, the lugs 72 and the grooves 74 are conducive to cleaning and drying of the components. While the bayonet-type connection 71 is preferred, in some applications it may be desirable to utilize other types of releasable connectors, including snap-fit type connectors and/or threaded connectors. However, it is noted that these alternatives may not provide the benefits described above in connection with the bayonet-type connection 71.

Figure 3:
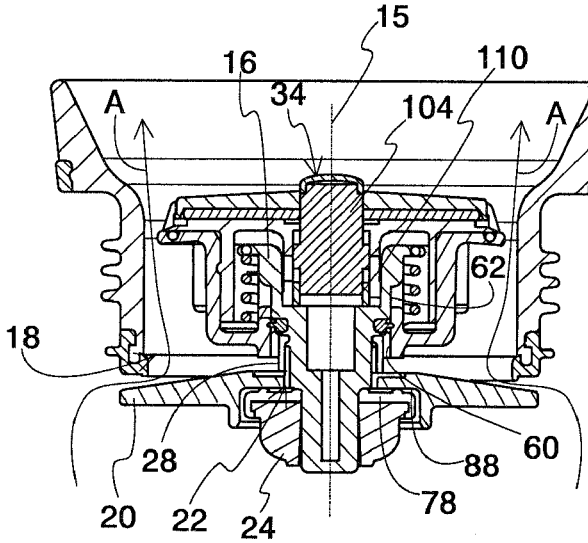
FIG. 3 is a view similar to FIGS. 1 and 2, but showing the drinking valve head in an open position and the pressure relief valve head in a closed position.

With reference top FIGS. 2A-5, a disk-shaped, annular seal 78 is preferably engaged on an upper surface 80 of the pressure relief valve head 24 so as to be sandwiched between the pressure relief valve head 24 and a shoulder 82 on the stem 16 when the bayonet connection 71 is in the locked position. In this regard, the resiliency of the seal material allows for the lugs 72 of the bayonet connection 71 to move along the circumferential portions 76 of the grooves 74 and then to be forced into the lug receiving recesses 77 by the reaction forces created by compressing the seal between the pressure relief valve head 24 and the shoulder 82 of the stem 16. It is also preferred for the annular seal 78 to be sandwiched between the pressure relief valve head 24 and the drinking valve head 20 with the pressure relief valve head 24 in the closed position (FIGS. 1 and 3) so as to prevent or restrict any leakage of the beverage through the pressure relief port 22. To optimize the sealing function, it is further preferred that a pair of upwardly extending annular ribs 84 and 86 be provided on the seal, as best seen in FIG. 2A, with one rib 84 engaging the shoulder 82 and the other rib 86 engaging a surface 88 on the thinking valve head 20 with the pressure relief valve head 24 in the closed position (FIGS. 1 and 3). Preferably, the seal 78 is retained to the pressure relief valve head 24 by an annular flange 90 of the pressure relief valve head 24 that is received within an annular groove 92 of the seal 78.

As best seen in FIGS. 4 and 5, the drinking valve head 20 is disk-shaped and includes the pressure relief port 22 defined by cylindrical guide surface 93 that is received on a corresponding cylindrical guide surface 94 of the valve stem 16, and a plurality of grooves 96 that are provided in the upper surface 97 and guide surface 93 of the drinking valve head 20 to insure that air can flow past the sleeve 28 with the pressure relief valve head 24 in the open position, as best seen in FIG. 4A. While other shapes may are possible, the upper surface 97 of the drinking valve head 20 is preferably frustoconical, which helps to provide a desired flow area with the valve head 20 in the open position. Preferably, an annular seal or gasket 98 is received on the end of the skirt 40 and includes an annular valve seat or seal surface 100 that engages' against the upper surface 97 of the drinking valve head 20 in the closed position so as to restrict or prevent any leakage of the beverage past the valve head 20 in the closed position. While it may be desirable in some applications to be provided separately, the annular seal 100 preferably also includes a radially extending annular seal surface 102 that is engageable with an interior wall of the container to prevent or restrict leakage of the beverage past the skirt 40 and the container.

As best seen in FIG. 4, in the illustrated embodiment, the push button actuator 34 includes a push button member 104 having a series of axially facing, circumferentially extending ramps 106 that are engageable with a corresponding series of axially facing, circumferentially extending ramps 108 formed on a ring-shaped member 110 that is rotatably received within a cylindrical opening 112 of the valve stem 16. The circumferential ramps 106 and 108 are configured in a known manner such that in one relative circumferential position the ramps 106 and 108 provide a first axial spacing between the push button member 104 and the ring-shaped member 110 to allow the valve stem 16 to move to the closed position, as shown in FIG. 1, and in a second relative circumferential position provide a second axial spacing, larger than the first, that retains the valve stem 16 in an open position, as seen in FIG. 5. This type of push button actuator is commonly used in ball point pens and it will be appreciated that other forms of push button actuators, including a simple extension of the valve stem 16 may be desirable depending upon the particular application. Furthermore, it should be understood that other forms of manual actuators that are capable of transmitting a force from a user to translate the valve stem 16 may be desirable depending on the requirements of a particular application. The actuator housing 36 preferably includes a downwardly extending skirt 114 having either a snap fit connector or a threaded connection with an inside cylindrical surface 116 of the mount housing 58, as shown generally at 118 in FIG. 2. The actuator housing 36 further includes a cylindrical pilot opening 120 that guides the push button member 104 as it translates along the axis 15. The housing 36 further includes a generally disk-shaped upper portion 122 that engages a seal 124 formed in an upper surface of the housing 14.

In operation, the valve stem 16 is urged downwardly by the actuator 34 when pushed by a user, the resilient sleeve 28 deforms to allow the pressure relief valve head 24 to move from the closed position to the open position (FIGS. 2 and 2A), which in turn allows for an equalization of pressure across the drinking valve head 20 which is then translated relative to the stem 16 and pressure relief valve head 20 to its open position by the reaction forces in the resilient sleeve 28, as shown in FIG. 5, and is maintained in the open position by the sleeve 28.

Any suitable reliant material may be used for the resilient sleeve 28 and the various seals, such as for example, a food grade silicon rubber. Further, the remaining components of the lid can be formed from any suitable structural material, such as suitable food grade plastics.

It will be appreciated that by providing the releasable connector between the pressure relief valve head and the stem, the disclosed invention allows for the critical components of the lid to be easily disassembled and reassembled for cleaning and/or replacement.

The invention claimed is:

1. A leak resistant, drinking lid for use with a beverage container, the lid comprising:

a housing to mount the lid to the container;

a manually actuated valve stem mounted to the housing to translate relative to the housing in response to manual actuation by a user;

a drinking port extending through the housing to allow a beverage in the container to pass through the lid for drinking by a user;

a drinking valve head carried on the stem for movement relative to the housing between a closed position closing the drinking port and an open position wherein the beverage can flow through the drinking port;

a pressure relief port extending through the drinking valve head to allow Equalization of pressure across the drinking valve head with the drinking valve head in the closed position; and a pressure relief valve head releasably mounted to the stem by a connector for movement relative to the drinking valve head between a closed position closing the pressure relief port and an open position wherein air can pass through the pressure relief port, the drinking valve head captured on the stem by the pressure relief valve head.

2. The lid of claim 1 further comprising a resilient member sandwiched between the stem and the drinking valve head to transmit an actuating force from the stem to the drinking valve head and to allow the stem and the pressure relief valve head to translate relative to the drinking valve head.

3. The lid of claim 2 wherein the resilient member is a resilient sleeve through which a portion of the stem extends.

4. The lid of claim 3 wherein the resilient sleeve has an annular rib received within an annular groove of the stem to fix the sleeve to the stem.

5. The lid of claim 3 wherein the drinking valve head has a surface engaged with the resilient sleeve, the surface interrupted by a plurality of grooves to allow a flow of air past the sleeve with the pressure relief valve head in the open position.

6. The lid of claim 1 further comprising an annular seal sandwiched between the pressure relief valve head and the stem.

7. The lid of claim 6 wherein the seal is also sandwiched between the pressure relief valve head and the drinking valve head with the pressure relief valve head in the closed position.

8. The lid of claim 7 wherein the pressure relief valVe head includes an annular flange received in an annular groove of the seal to retain the seal on the valve head.

9. The lid of claim 1 wherein the connector is a bayonet type connector.

10. The lid of claim 9 wherein the bayonet type connector comprises a pair of lugs on the pressure relief valve head and a pair of corresponding lug receiving grooves in the valve stem.

11. The lid, of claim 1 further comprising a push button actuator engaged with the valve stem to allow a user to translate the valve stem relative to the housing.

12. The lid of claim 11 wherein the push button actuator comprises a pair of mating ramped surfaces, the surfaces movable relative to each other between first and second positions in response to an actuating force applied by a user, the first position allowing the drinking valve head to move to the dosed position, the second position maintaining the drinking valve head in the open position.

13. The lid of claim 1 further comprising a spring sandwiched between the valve stem and the housing to urge the valve heads toward the closed positions.

14. The lid of claim 13 wherein the spring is a helical spring.

15. The lid of claim 14 wherein the valve stem includes an annular flange engaged against the spring, the valve stem being a one-piece construction.

16. A leak resistant, drinking lid for use with a beverage container, the lid comprising:

a housing to mount the lid to the container;

a manually actuated valve stem mounted to the housing to translate relative to the housing in response to manual actuation by a user;

a drinking port extending through the housing to allow a beverage in the container to pass through the lid for drinking by a user;

a drinking valve head carried on the stem for movement relative to the housing between a closed position closing the drinking port and an open position wherein the beverage can flow through the drinking port;

a pressure relief port extending through the drinking valve head to allow equalization of pressure across the drinking valve head with the drinking valve head in the closed position;

a pressure relief valve head carried on the stem for movement relative to the drinking valve head between a closed position closing the pressure relief port and an open position wherein air can pass through the pressure relief port, the drinking valve head captured on the stem by the pressure relief valve head; and a resilient member sandwiched between the stem and the drinking valve head to transmit an actuating force from the stem to the drinking valve head and allow the stem and the pressure relief valve head to translate relative to the drinking valve head.

17. The lid of claim 16 wherein the resilient member is a resilient sleeve through which a portion of the stem extends.

18. The lid of claim 17 wherein the resilient sleeve has an annular rib received within an annular groove of the stem to fix the sleeve to the stem.

19. The lid of claim 17 wherein the drinking valve head has a surface engaged with the resilient sleeve, the surface interrupted by a plurality of grooves to allow a flow of air past the sleeve with the pressure relief valve head in the open position.

20. The lid of claim 16 wherein the pressure relief valve head is connected to the stem with a bayonet type connection.

* * * * *

UNITED STATES PATENT AND TRADEMARK OFFICE

CERTIFICATE OF CORRECTION

PATENT NO. : 8,348,078 B2
APPLICATION NO. : 12/705000
DATED : January 8, 2013
INVENTOR(S) : Marvin Lane It is certified that error appears in the above-identified patent and that said Letters Patent is hereby corrected as shown below:

Claim 1 (column 6, line 65), delete “Equalization” and substitute therefor “equalization”.

Claim 8 (column 7, line 27), delete “valVe” and substitute therefor “valve”.

Claim 12 (column 7, line 44), delete “dosed” and substitute therefor “closed”.

Signed and Sealed this
Twenty-sixth Day of February, 2013

Teresa Stanek Rea
*Acting Director of the United States Patent and Trademark Office*